United States Patent [19]

Kawata

[11] 4,328,188

[45] May 4, 1982

[54] CATALYTIC CONVERTERS FOR EXHAUST SYSTEMS OF INTERNAL COMBUSTION ENGINES

[75] Inventor: Masayuki Kawata, Hiroshima, Japan

[73] Assignee: Toyo Kogyo Co., Ltd., Hiroshima, Japan

[21] Appl. No.: 240,585

[22] Filed: Mar. 4, 1981

[30] Foreign Application Priority Data

Mar. 5, 1980 [JP] Japan ..... 55-29303[U]

[51] Int. Cl.[3] ..... F01N 3/10

[52] U.S. Cl. ..... 422/180; 422/176

[58] Field of Search ..... 422/176, 177, 180

[56] References Cited

U.S. PATENT DOCUMENTS

| | | | |
|---|---|---|---|
| 3,597,165 | 8/1971 | Keith et al. | 422/180 |
| 3,852,042 | 12/1974 | Wagner | 422/180 X |
| 3,957,445 | 5/1976 | Foster | 422/180 X |
| 3,984,207 | 10/1976 | Abthoff et al. | 422/180 X |
| 4,002,433 | 1/1977 | Oser | 422/176 |
| 4,065,918 | 1/1978 | Rifkin | 422/180 X |
| 4,182,120 | 1/1980 | Niebylski | 422/180 X |
| 4,256,700 | 3/1981 | Smith et al. | 422/180 X |

FOREIGN PATENT DOCUMENTS

| | | |
|---|---|---|
| 55-1902 | 1/1980 | Japan . |
| 55-1932 | 1/1980 | Japan . |

*Primary Examiner*—Richard L. Chiesa
*Attorney, Agent, or Firm*—Fleit & Jacobson

[57] ABSTRACT

A catalytic converter including a casing which is comprised of a pair of shells welded together along peripheries thereof. A catalyst unit is located in the casing with the downstream end supported by a shoulder formed in the casing. The upstream end of the catalyst unit is held by a retaining flange of a retaining member which also has a baffle portion for distributing the exhaust gas throughout the cross-section of the catalyst unit. The retaining member is welded to the casing to thereby hold the catalyst unit against longitudinal movements.

10 Claims, 4 Drawing Figures

CATALYTIC CONVERTERS FOR EXHAUST SYSTEMS OF INTERNAL COMBUSTION ENGINES

The present invention relates to catalytic converters for use in exhaust systems of internal combustion engines.

Conventional catalytic converters for internal combustion engines include a casing carrying one or more monolithic catalytic units which are comprised of ceramic substrates having catalyst materials deposited thereon. The casing has opposite end portions which are generally tapered to provide an inlet and outlet openings of smaller diameters formed at longitudinally opposite ends thereof for connection with exhaust pipe sections. In order to support the catalyst unit against longitudinal movements, the casing is provided with a shoulder for engagement directly or through a suitable resilient member with one of longitudinal ends of the catalyst unit. At the other longitudinal end, the casing has a retaining ring which is adapted to be engaged with the catalytic unit and welded to the casing.

In an automobile catalytic converter which is usually arranged in an under-floor space, it is preferable that the casing be of an oval cross-sectional configuration with a height smaller than the width thereof. Therefore, from the viewpoint of manufacture, the casing is often designed to be of a two-piece construction comprising an upper and lower shells which are welded together along the peripheries thereof. In assembling a catalytic converter having this type of casing, the catalyst unit is placed in one of the shells and the retaining ring is welded to the shell at a position wherein the catalyst unit is firmly held between the shoulder and the retaining ring. The other shell is then placed over the first shell to cover the catalyst unit and welding operation is performed. In this procedure, however, the retaining ring is no longer accessible so that it is quite difficult to locate and weld the retaining ring to the second shell without any appreciable clearance with respect to the catalyst unit. Thus, in this type of converter, clearance may be produced in the second shell between the retaining ring and catalyst unit so that the unit is allowed to move under engine vibrations and pulsations of exhaust gas with the result that the catalyst unit be broken by being repeatedly hit against the retaining ring and the shoulder of the casing.

In a catalytic converter having a casing of a oval cross-sectional configuration, it is recommendable to provide a baffle member at the inlet end portion so that the exhaust gas flow is substantially uniformly distributed throughout the cross-section of the catalyst unit. Examples of such catalytic converters are disclosed by Japanese laid-open utility model applications 55-1902 and 55-1932. In this type of structure, difficulties are further encountered in locating and welding the baffle member to the casing.

In the U.S. Pat. No. 3,852,042 issued to Melvin H. Wagner on Dec. 3, 1974, there is disclosed a catalytic converter wherein the casing is constituted by a cylindrical center member and a pair of end members welded to the longitudinally opposite ends of the center member. One of the end members provides a shoulder for supporting one longitudinal end of the catalyst unit, and screen members and a spacer ring are provided between the other longitudinal end of the catalyst unit and the other end member. This type of structure may be possible to hold the catalytic unit against longitudinal displacements, however, it should be noted that the structure is very inconvenient to apply to a converter of oval cross-sectional configuration.

It is therefore an object of the present invention to provide a catalytic converter which can readily be assembled in a manner such that the catalyst unit be held firmly against longitudinal movements.

Another object of the present invention is to provide a catalytic converter which has a casing of two-piece construction but is convenient to assemble with the catalyst unit held against longitudinal movements.

According to the present invention, in order to accomplish the above and other objects, there is provided a catalytic converter including a casing comprised of a pair of shells which are welded together along peripheries thereof, said shells respectively having inside recessed portions which provide when they are mated one against the other a space of oval cross-sectional configuration having a height smaller than a width, said casing having longitudinally opposite inlet and outlet end portions formed respectively with inlet and outlet openings which are located opposite to each other with respect to said space, a monolithic catalyst unit having a plurality of longitudinally extending gas passages and located in said space of the casing so that engine exhaust gas admitted through the inlet opening of the casing is passed through the gas passages of the catalyst unit to the outlet opening of the casing, support means provided in the casing at an end of the space adjacent to the outlet opening for engagement with one longitudinal end of the catalyst unit, retaining means provided in the casing at an end of the space adjacent to the inlet opening and including a retaining portion for engagement with the other longitudinal end of the catalyst unit, said retaining means further including a baffle portion formed integrally with said retaining portion for distributing the engine exhaust gas throughout the cross-section of the space, means for securing said retaining means to said casing. The catalytic converter in accordance with the features of the present invention is very convenient to assemble. The shells are at first welded together to form the casing with the catalyst unit located in the space of the casing and the retaining means in the inlet end portion thereof. Then, a locating tool is inserted through the inlet opening of the casing until it is abutted to the baffle portion of the retaining means. The tool is further forced into the casing so that the catalyst unit is urged through the retaining portion of the retaining means against the support means in the casing. In this position, the retaining means is secured to the casing by the securing means.

It will be understood that according to the arrangement of the present invention, it is possible to hold the catalyst unit firmly against longitudinal movements in the casing. The support means may be in the form of a shoulder formed in the casing and may be engaged with the catalyst unit directly or indirectly through a suitable resilient member. The shoulder may be integrally formed with the casing or separately formed and thereafter welded to the casing. The retaining means may be formed integrally by a single metal sheet and may have a connecting portion between the retaining and baffle portions. The connecting portion may have areas which lie along the casing so that it can be welded to the casing at those areas.

According to another aspect of the present invention, the casing may not necessarily be of an oval but may be of a circular cross-section. Even in this type of casing configuration, the baffle portion is required to distribute the exhaust gas radially outwardly and the baffle portion can also be used to apply the longitudinal force to the retaining portion so that the catalyst unit is firmly held in the casing.

The above and other objects and features of the present invention will become apparent from the following descriptions of a preferred embodiment taking reference to the accompanying drawings, in which.

Figure 1:
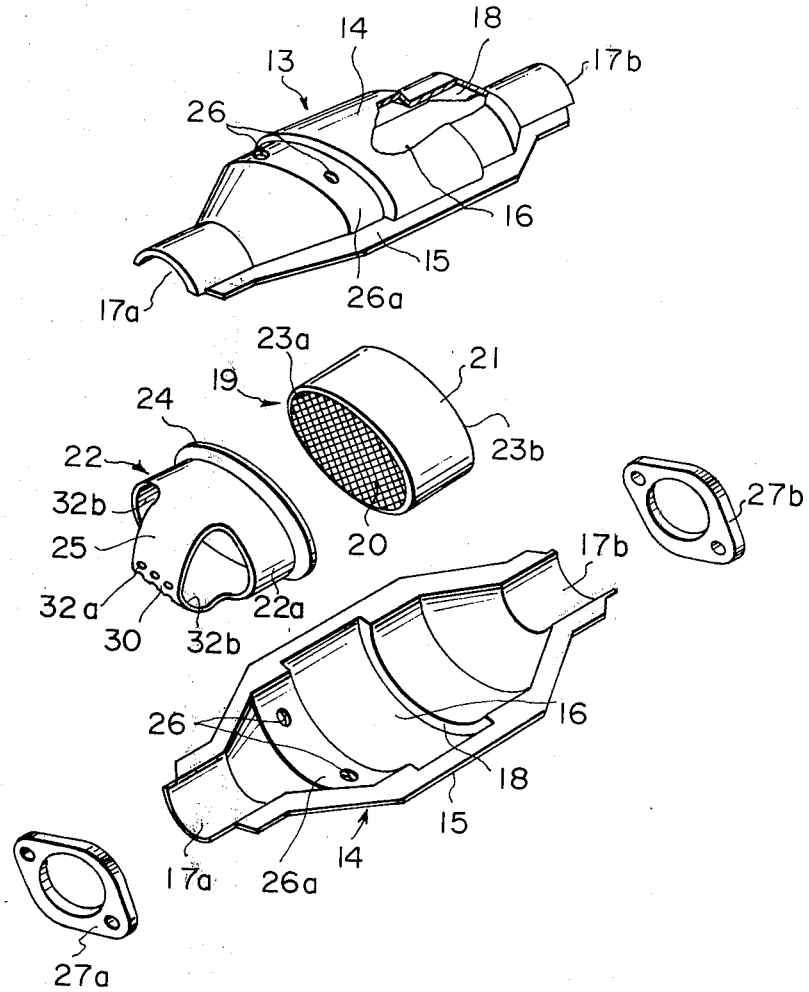
FIG. 1 is an exploded perspective view of a catalytic converter in accordance with one embodiment of the present invention.

Referring now to the drawings, the catalytic converter shown therein includes a casing 13 comprised of a pair of shells 14 which may be formed by pressing sheets of a corrosion resistant steel. The shells 14 have peripheral flanges 15 which are welded together to form the casing 13. The shells 14 are formed respectively with recessed portions 16 which provide, when the shells 14 are assembled together, a space of an oval cross-sectional configuration with a height substantially smaller than the width thereof. At the longitudinally opposite end portions of the shells 14, there are respectively formed inlet and outlet semi-tubular sections 17*a* and 17*b*, respectively. When the shells 14 are assembled together, the sections 17*a* form an inlet opening and the sections 17*b* an outlet opening, both of a circular cross-section. Between the space defined by the recesses 16 and the inlet opening, the shells 14 have generally tapered sections which provide, together with the sections 17*a*, an inlet end portion of the casing 13. Similarly, the shells 14 are formed with generally tapered sections between the space and the outlet opening for defining an outlet end portion together with the sections 17*b*. At the end of the space adjacent to the outlet end portion, the shells 14 are formed with shoulders 18.

The catalytic converter further includes a monolithic catalyst unit 19 which comprises a ceramic substrate deposited with catalyst materials such as platinum. The unit 19 may be of a honeycomb structure having a plurality of longitudinally extending gas passages 20. The catalyst unit 19 has a cross-sectional configuration corresponding to that of the space defined by the recesses 16 and is wrapped around its outer surface by a suitable cushion material 21 such as ceramic fibers, glass fibers, asbestos or steel wool. The catalyst unit 19 has an inlet and outlet ends 23*a* and 23*b*, respectively, and is located in the space defined by the recesses 14 with the periphery of the outlet end 23*b* seated on the shoulders 18. It should be noted that a spring or other resilient member may be disposed between the catalyst unit 19 and the shoulders 18.

In the inlet end portion, there is a retaining member 22 which may be made of a sheet of a corrosion resistant steel and includes an annular retaining flange 24 adapted to be engaged with the periphery of the inlet end 23*a* of the catalyst unit 19. The retaining member 22 further includes a front end portion or baffle portion 25 which is integrally connected with the retaining flange 24 through a tubular connecting portion 22*a* of an oval cross-sectional configuration. As shown in FIG. 1, the shells 14 are formed at the inlet portion with lands 26*a* which define an oval section in the casing in front of the catalyst unit 19 when the converter is assembled. The retaining member 22 is placed in position with the tubular connecting portion 22*a* laid along the lands 26*a*.

The baffle portion 25 of the member 22 has a central area 30 formed with a plurality of apertures 32*a* and side areas formed with large-diameter holes 32*b* which are opposite to each other with respect to the central area 30 along the major axis of ellipse of the cross-section of the casing 13. The baffle portion 25 thus functions to direct the flow of the engine exhaust gas admitted through the inlet opening sidewardly along the major axis of the ellipse to thereby distribute the exhaust gas substantially throughout the cross-section of the catalyst unit 19. In the lands 26*a* of the shells 14, there are formed welding holes 26. The casing 13 has connecting flanges 27*a* and 27*b* which are welded to the semi-tubular sections 17*a* and 17*b*, respectively, so that the catalytic converter can be connected with engine exhaust pipe sections (not shown) through these connecting flanges 27*a* and 27*b*.

Figure 2:
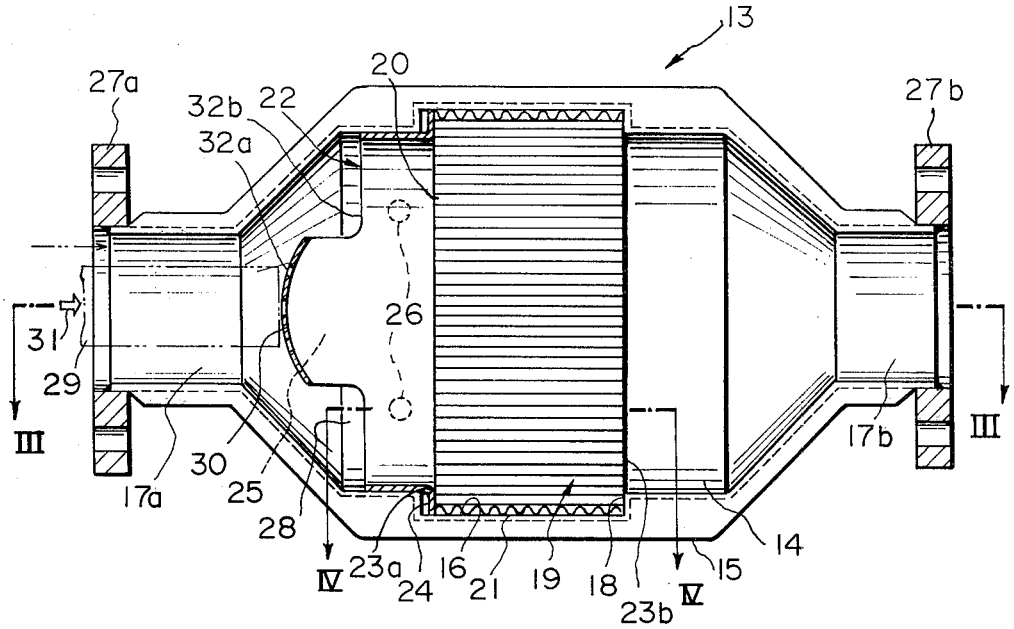
FIG. 2 is a horizontal sectional view of the catalytic converter.
Figure 3:
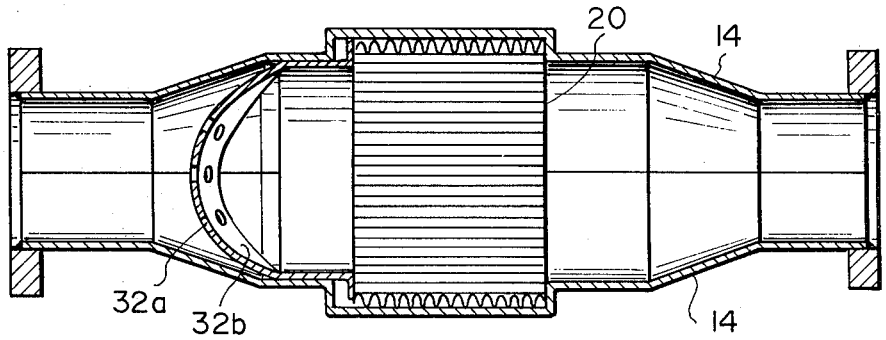
FIG. 3 is a vertical sectional view taken substantially along the line III—III in FIG. 2; and, FIG. 4 is a fragmentary sectional view taken substantially along the line IV—IV in FIG. 2.
Figure 4:
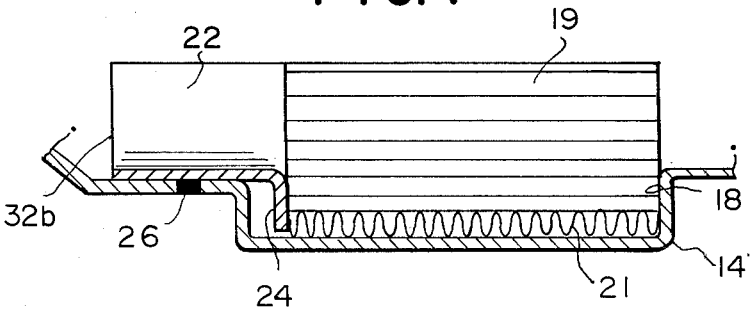

After the shells 14 are assembled and welded together as described above along the flanges 15 thereof with the catalyst unit 19 received in the space defined by the recesses 16 and the retaining member 22 located in front of the unit 19, a rod-like tool 29 is inserted through the inlet opening of the casing 13 as shown by phantom lines in FIG. 2. The tool 29 engages the central area 30 of the baffle portion 25 of the retaining member 22 and, as the tool 29 is forced further toward left in FIG. 2, the retaining member 22 and the catalyst unit 19 are forced rightward so that the periphery of the outlet end 23*b* of the unit 19 is firmly engaged with the shoulders 18 of the shells 14 and the retaining flange 24 of the retaining member 22 is firmly engaged with the inlet end 23*a* of the unit 19 throughout the periphery thereof. In this position, the retaining member 22 is welded to the shells 14 through the welding holes 26 formed in the lands 26*a* as shown in FIG. 4. In this manner, the catalyst unit 19 is firmly held in the casing 13 between the retaining flange 24 of the retaining member 22 and the shoulders 18 against longitudinal movements.

In the catalytic converter described above, the exhaust gas is admitted into the casing 13 through the inlet opening defined by the semi-tubular sections 17*a* of the shells 14 as shown by an arrow 31 in FIG. 2. The baffle portion 25 formed in the retaining member 22 serves to expand the flow of the exhaust gas sidewardly along the major axis of the ellipse of the cross-section of the casing 13 so that the exhaust gas is distributed substantially throughout the cross-section of the catalyst unit 19. The retaining flange 24 of the retaining member 22 functions not only to hold the unit 19 but to prevent the exhaust gas from flowing into the space between the outer surface of the catalyst unit 19 and the casing 13.

It should be understood that, although the present invention has been shown and described with reference to a specific embodiment, the invention is in no way limited to the details of the illustrated structures but changes and modifications may be made without departing from the scope of the appended claims. For example, in the illustrated embodiment, only one catalyst unit is contained in the casing, however, the present invention can well be applied to a catalytic converter having a plurality of catalyst units arranged in series. Further, a resilient member such as a spring may be positioned between the retaining flange and the inlet end of the catalyst unit.

I claim:

1. A catalytic converter including a casing comprised of a pair of shells which are welded together along peripheries thereof, said shells respectively having inside recessed portions which provide when they are mated one against the other a space of oval cross-sectional configuration having a height smaller than a width, said casing having longitudinally opposite inlet and outlet end portions formed respectively with inlet and outlet openings which are located opposite to each other with respect to said space; a monolithic catalyst unit having a plurality of longitudinally extending gas passages and located in said space of the casing so that engine exhaust gas admitted through the inlet opening of the casing is passed through the gas passages of the catalyst unit to the outlet opening of the casing; support means provided in the casing at an end of the space adjacent to the outlet opening for engagement with one longitudinal end of the catalyst unit; a retaining member made of a single piece of metal plate and provided in the casing at an end of the space adjacent to the inlet opening, said retaining member including a retaining portion for engagement with the other longitudinal end of the catalyst unit, a baffle portion for distributing the engine exhaust gas throughout the cross-section of the space, and a connecting portion integrally connecting the retaining portion with the baffle portion; and means for securing the connecting portion of said retaining member to said casing.

2. A catalytic converter in accordance with claim 1 in which said baffle portion having apertures which provide larger areas of opening in opposite side portions than in central portion.

3. A catalytic converter in accordance with claim 2 in which said connecting portion is of a cylindrical configuration, said retaining portion being comprised of a flange extending radially outwardly from said connecting portion.

4. A catalytic converter in accordance with claim 1 in which said retaining member is comprised of an integral sheet-metal member having at least one area laid along a part of said casing, said securing means including welding holes formed in said part of the casing and said sheet-metal member being welded to the casing at the welding holes.

5. A catalytic converter in accordance with claim 1 in which said connecting portion of the retaining member is of a cylindrical configuration and has a cross-section corresponding to that of the casing so as to be laid along the casing to be secured thereto by said securing means.

6. A catalytic converter in accordance with claim 1 in which said connecting portion of the retaining member is of a cylindrical configuration, said retaining portion being comprised of a flange extending radially outwardly from said connecting portion.

7. A catalytic converter including a casing comprise of a pair of shells which are welded together along peripheries thereof, said shells respectively having inside recessed portions which provide a space when they are mated one against the other, said casing having longitudinally opposite inlet and outlet end portions formed respectively with inlet and outlet openings which are located opposite to each other with respect to said space; a monolithic catalyst unit having a plurality of longitudinally extending gas passages and located in said space of the casing so that engine exhaust gas admitted through the inlet opening of the casing is passed through the gas passages of the catalyst unit to the outlet opening of the casing; support means provided in the casing at an end of the space adjacent to the outlet opening for engagement with one longitudinal end of the catalyst unit; a retaining member made of a sheet metal material and provided in the casing at an end of the space adjacent to the inlet openings, said retaining member including a retaining portion for engagement with the other longitudinal end of the catalyst unit, a baffle portion for distributing the engine exhaust gas throughout the cross section of the space, and a connecting portion integrally connecting the retaining portion with the baffle portion; and means for securing said connecting portion of the retaining member to said casing.

8. A catalytic converter in accordance with claim 7 in which the connecting portion of said retaining member has at least one area laid along a part of said casing, said securing means including welding holes formed in said part of the casing and said retaining member of sheet-metal material being welded to the casing at the welding holes.

9. A catalytic converter in accordance with claim 7 in which said connecting portion of the retaining member is of a cylindrical configuration, said retaining portion being comprised of a flange extending radially outwardly from said connecting portion.

10. A catalytic converter in accordance with claim 9 in which said baffle portion has apertures which provide larger areas of opening in opposite side portions than in central portion.

* * * * *